US008523314B2

(12) United States Patent
Sato et al.

(10) Patent No.: US 8,523,314 B2
(45) Date of Patent: Sep. 3, 2013

(54) INK JET RECORDING APPARATUS TO UTILIZE INK AND REACTION LIQUID THAT AGGLUTINATES WHEN REACTED WITH COLORING MATERIAL-CONTAINING INK

(75) Inventors: Kazuhiko Sato, Tokyo (JP); Kazuo Suzuki, Yokohama (JP); Taku Yokozawa, Yokohama (JP); Yosuke Ishii, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 341 days.

(21) Appl. No.: 12/706,235

(22) Filed: Feb. 16, 2010

(65) Prior Publication Data

US 2010/0214353 A1 Aug. 26, 2010

(30) Foreign Application Priority Data

Feb. 24, 2009 (JP) ..... 2009-041000

(51) Int. Cl.
*B41J 2/15* (2006.01)
*B41J 2/165* (2006.01)

(52) U.S. Cl.
USPC ..... 347/21; 347/35

(58) Field of Classification Search
USPC ..... 347/21
See application file for complete search history.

(56) References Cited

U.S. PATENT DOCUMENTS

| | | | | |
|---|---|---|---|---|
| 6,155,666 | A * | 12/2000 | Sugimoto et al. | 347/24 |
| 7,287,826 | B2 * | 10/2007 | Aldrich et al. | 347/35 |
| 2001/0038400 | A1 * | 11/2001 | Yamada et al. | 347/36 |
| 2002/0109746 | A1 * | 8/2002 | Murakami et al. | 347/29 |
| 2003/0025745 | A1 * | 2/2003 | Kawatoko et al. | 347/35 |
| 2004/0041862 | A1 * | 3/2004 | Nakagawa et al. | 347/9 |
| 2005/0200649 | A1 * | 9/2005 | Yamaguchi et al. | 347/21 |

FOREIGN PATENT DOCUMENTS

| | | | |
|---|---|---|---|
| JP | 2001301145 | A * | 10/2001 |
| JP | 2007136819 | A * | 6/2007 |
| JP | 2007-253407 | A | 10/2007 |

OTHER PUBLICATIONS

Machine generated English translation of JP2007-253407 to Hirakawa Takashi, "Image Formation Device," generated May 7, 2012 via http://www19.ipdl.inpit.go.jp/PAI/cgi-bin/PAIINDEX; 16pp.*

Machine generated English translation of specification of JP 2007-136819A, "Inkjet Recording Head, Inkjet Recording Device, and Inkjet Recording Method" to Nishiguchi et al., generated via http://www19.ipdl.inpit.go.jp/PAI/cgi-bin/PAIINDEX on Aug. 21, 2012, 23 pp.*

* cited by examiner

*Primary Examiner* — Shelby Fidler

(74) *Attorney, Agent, or Firm* — Canon USA, Inc., IP Division

(57) ABSTRACT

Suitable preliminary discharge conditions are set for a recording head using reaction liquid in bidirectional recording. While the recording head makes a reciprocating motion and scans a recording medium, a preliminary discharge of the reaction liquid is executed after recording on the recording medium from discharge ports on the rear side in a direction in which the recording head travels and a preliminary discharge of ink is executed when a preliminary discharge of the reaction liquid is not executed.

7 Claims, 11 Drawing Sheets

FIG.7A

| | PRELIMINARY DISCHARGE TIMING | | PRELIMINARY DISCHARGE AMOUNT FROM REACTION LIQUID NOZZLES ON HP SIDE | PRELIMINARY DISCHARGE AMOUNT FROM COLORING MATERIAL-CONTAINING INK NOZZLES | PRELIMINARY DISCHARGE AMOUNT FROM REACTION LIQUID NOZZLES ON BP SIDE |
|---|---|---|---|---|---|
| (1) | BEFORE RECORDING | HP SIDE | – | 20 DOTS/100pl | – |
| (2) | AFTER RECORDING | BP SIDE | – | – | 20 DOTS/100pl |
| (3) | BEFORE RECORDING | BP SIDE | – | 20 DOTS/100pl | – |
| (4) | AFTER RECORDING | HP SIDE | 20 DOTS/100pl | – | – |

FIG.7B

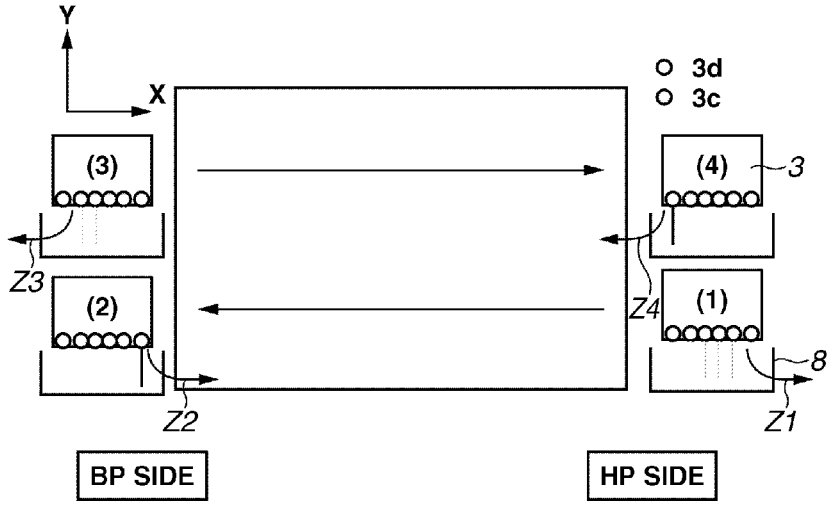

FIG.8A

| | PRELIMINARY DISCHARGE TIMING | | PRELIMINARY DISCHARGE AMOUNT FROM REACTION LIQUID NOZZLES ON HP SIDE | PRELIMINARY DISCHARGE AMOUNT FROM COLORING MATERIAL-CONTAINING INK NOZZLES | PRELIMINARY DISCHARGE AMOUNT FROM REACTION LIQUID NOZZLES ON BP SIDE |
|---|---|---|---|---|---|
| (1) | BEFORE RECORDING | HP SIDE | – | 20 DOTS/100pl | – |
| (2) | AFTER RECORDING | BP SIDE | 2 DOTS/10pl | – | 18 DOTS/90pl |
| (3) | BEFORE RECORDING | BP SIDE | – | 20 DOTS/100pl | – |
| (4) | AFTER RECORDING | HP SIDE | 18 DOTS/90pl | – | 2 DOTS/10pl |

FIG.8B

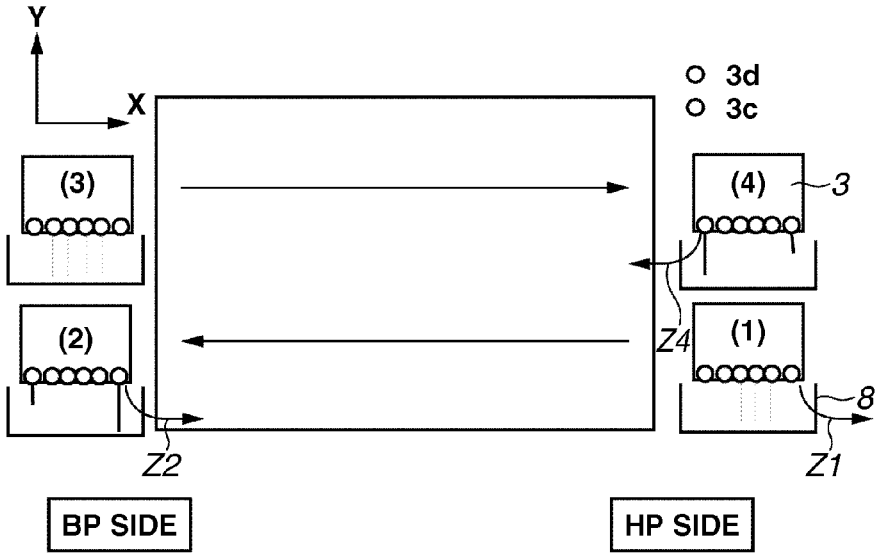

FIG.9A

| | PRELIMINARY DISCHARGE TIMING | | PRELIMINARY DISCHARGE AMOUNT FROM REACTION LIQUID NOZZLES ON HP SIDE | PRELIMINARY DISCHARGE AMOUNT FROM COLORING MATERIAL-CONTAINING INK NOZZLES | PRELIMINARY DISCHARGE AMOUNT FROM REACTION LIQUID NOZZLES ON BP SIDE |
|---|---|---|---|---|---|
| (1) | BEFORE RECORDING | HP SIDE | – | 20 DOTS/100pl | – |
| (2) | AFTER RECORDING | BP SIDE | – | – | 20 DOTS/100pl |
| (3) | BEFORE RECORDING | BP SIDE | – | – | – |
| (4) | AFTER RECORDING | HP SIDE | 20 DOTS/100pl | – | – |

FIG.9B

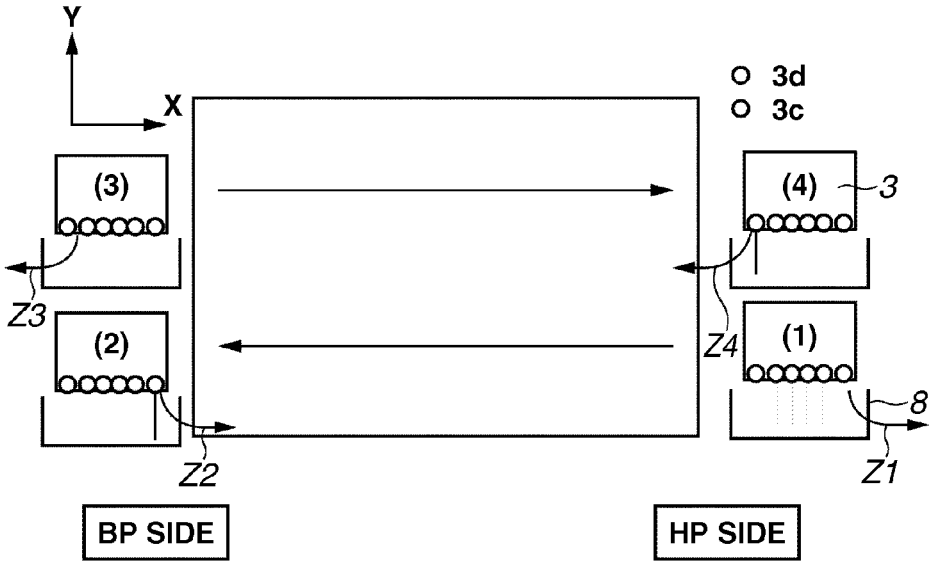

FIG.10A

| | PRELIMINARY DISCHARGE TIMING | | PRELIMINARY DISCHARGE AMOUNT FROM REACTION LIQUID NOZZLES ON HP SIDE | PRELIMINARY DISCHARGE AMOUNT FROM COLORING MATERIAL-CONTAINING INK NOZZLES | PRELIMINARY DISCHARGE AMOUNT FROM REACTION LIQUID NOZZLES ON BP SIDE |
|---|---|---|---|---|---|
| (1) | BEFORE RECORDING | HP SIDE | – | 20 DOTS/100pl | – |
| (2) | AFTER RECORDING | BP SIDE | – | – | – |
| (3) | BEFORE RECORDING | BP SIDE | – | – | – |
| (4) | AFTER RECORDING | HP SIDE | 20 DOTS/100pl | – | 20 DOTS/100pl |

FIG.10B

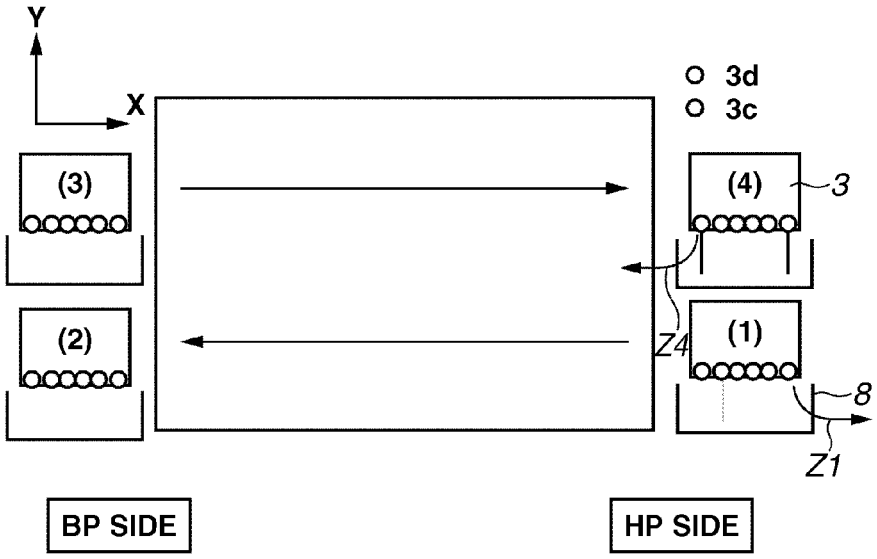

FIG.11A

| | PRELIMINARY DISCHARGE TIMING | | PRELIMINARY DISCHARGE AMOUNT FROM REACTION LIQUID NOZZLES ON HP SIDE | PRELIMINARY DISCHARGE AMOUNT FROM COLORING MATERIAL-CONTAINING INK NOZZLES | PRELIMINARY DISCHARGE AMOUNT FROM REACTION LIQUID NOZZLES ON BP SIDE |
|---|---|---|---|---|---|
| (1) | BEFORE RECORDING | HP SIDE | 20 DOTS/100pl | 20 DOTS/100pl | 20 DOTS/100pl |
| (2) | AFTER RECORDING | BP SIDE | – | – | – |
| (3) | BEFORE RECORDING | BP SIDE | 20 DOTS/100pl | 20 DOTS/100pl | 20 DOTS/100pl |
| (4) | AFTER RECORDING | HP SIDE | – | – | – |

FIG.11B

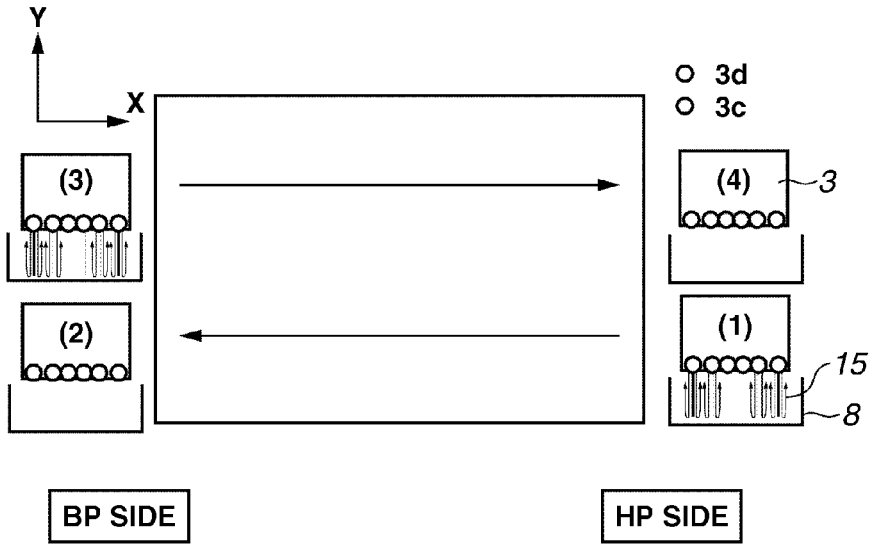

INK JET RECORDING APPARATUS TO UTILIZE INK AND REACTION LIQUID THAT AGGLUTINATES WHEN REACTED WITH COLORING MATERIAL-CONTAINING INK

BACKGROUND OF THE INVENTION

1. Field of the Invention

The present invention relates to an ink jet recording apparatus which executes recording by using a recording head which discharges ink. In particular, it relates to an ink jet recording apparatus which includes coloring material-containing ink and reaction liquid that agglutinates when reacted with the coloring material-containing ink.

2. Description of the Related Art

In recent years, along with the spread of information-processing equipment, recording apparatuses have spread rapidly as a peripheral device. Ink jet recording apparatuses use a recording head having a discharge port face on which a plurality of nozzles is arrayed, and recording is executed by causing the recording head to scan a recording medium and discharge ink droplets from discharge ports of the individual nozzles of the recording head during a scanning operation. Such ink jet recording apparatuses have various advantages; for example, they can easily be miniaturized and can execute color recording relatively easily. Thus, these ink jet recording apparatuses have spread rapidly.

Further, there has conventionally been known an ink jet recording apparatus that uses reaction liquid for recording, along with ink containing coloring materials such as cyan, magenta, yellow, and black. Use of such reaction liquid can suppress ink bleed and increase density. However, when a recording head supplied with both of the ink and reaction liquid is used, a mist of reaction liquid and ink attaches to and then firmly adheres to the face of the recording head, easily resulting in a defective discharge. This problematical ink adhesion will be next described with reference to FIGS. 5 and 6.

FIG. 5 is a sectional view of an ink jet recording apparatus, and FIG. 6 illustrates air currents during a preliminary discharge. In FIG. 5, recording is executed by a recording head 3 discharging ink on a recording surface 13 of a recording medium 12, and a preliminary discharge is executed into a preliminary discharge receptacle 8. Moisture of the preliminarily discharged ink is evaporated, and the ink is then thickened and deposited. Since a surface 11 having a discharge port face 3*b* on the recording head 3 may be smeared by the deposit, the distance between the surface 11 and the preliminary discharge receptacle 8 needs to be greater than the difference between the surface 11 and the recording surface 13 of the recording medium 12.

However, if the distance between the surface 11 and the preliminary discharge receptacle 8 is increased, the ink mist may roll up more easily during a preliminary discharge. As illustrated in FIG. 5, when the distance between the surface 11 and the recording surface 13 is short, the ink mist is relatively small during recording. In contrast, as illustrated in FIG. 6, when the distance between the surface 11 and the preliminary discharge receptacle 8 is large, a greater amount of the ink mist is generated. Further, when both of the ink and the reaction liquid are discharged from adjacent nozzles at the same time, air currents produced due to the discharge are overlapped and increased. Particularly, since all the nozzles discharge ink during a preliminary discharge, large ascending air currents are generated. These ascending air currents roll up and attach the ink mist to the discharge port face 3*b*. The attached ink and reaction liquid 14 react with each other and adhere to the discharge port face 3*b*, resulting in a defective discharge.

"Japanese Patent Application Laid-Open No. 2007-253407" proposes a method to solve the above problem. According to the method, by executing preliminary discharges of ink and reaction liquid at different timings, the ink adhesion caused by the reaction between ink and reaction liquid inside a preliminary discharge receptacle is prevented.

However, even when the method discussed in "Japanese Patent Application Laid-Open No. 2007-253407" is used, adhesion of the ink mist, produced by the ink and reaction liquid, to the face of the recording head cannot sufficiently be suppressed, and thus, there is room for improvement. Namely, when bidirectional recording is executed with a recording head on which a reaction liquid discharge port array is arranged on either side of a ink discharge port array, if a preliminary discharge is executed from both of the reaction liquid discharge port arrays, an ink mist of reaction liquid easily attaches to the ink discharge port array. Particularly, when a preliminary discharge is executed while the recording head executes a scanning operation, a mist of the reaction liquid preliminarily discharged from the reaction liquid discharge port array on the front side of the ink discharge port array in a direction in which the recording head travels easily attaches to the ink discharge port array.

SUMMARY OF THE INVENTION

The present invention is directed to an ink jet recording apparatus in which preliminary discharge timings of coloring material-containing ink and reaction liquid are controlled to suppress ink adhesion to a discharge port face, which is caused by the ink mist produced during a preliminary discharge.

According to an aspect of the present invention, an ink jet recording apparatus includes: a scanning unit configured to cause a recording head to make a reciprocating motion and scan a recording medium in bidirectional recording, the recording head including: an ink discharge port array formed by a plurality of discharge ports that discharges coloring material-containing ink and that is arranged in a predetermined direction; and a plurality of reaction liquid discharge port arrays each formed by a plurality of discharge ports that discharges reaction liquid reacting with the ink and that is arranged in the predetermined direction, the plurality of reaction liquid discharge port arrays being arranged to sandwich the ink discharge port array in a direction perpendicular to the predetermined direction; a preliminary discharge unit configured to cause the recording head to execute a preliminary discharge of the ink and the reaction liquid; and a preliminary discharge receptacle arranged inside a scanning area of the recording head and outside the recording medium and configured to receive the ink and the reaction liquid preliminarily discharged from the recording head, wherein the preliminary discharge unit causes the recording head to execute, regardless of a forward or backward scanning operation, (A) a preliminary discharge of the reaction liquid from the reaction liquid discharge port array on the rear side of the ink discharge port array in a direction in which the recording head travels among the plurality of reaction liquid discharge port arrays and (B) a preliminary discharge of the ink when a preliminary discharge of the reaction liquid is not executed.

According to the present invention, by controlling preliminary discharge timings of coloring material-containing ink and reaction liquid, rolling-up of the ink mist produced during a preliminary discharge can be suppressed, and ink adhesion to a discharge port face can be improved.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIGS. 7A and 7B illustrate preliminary discharge timings and amounts according to a first exemplary embodiment.

FIGS. 8A and 8B illustrate preliminary discharge timings and amounts according to a second exemplary embodiment.

FIGS. 9A and 9B illustrate preliminary discharge timings and amounts according to a third exemplary embodiment.

FIGS. 10A and 10B illustrate preliminary discharge timings and amounts according to the third exemplary embodiment.

FIGS. 11A and 11B illustrate preliminary discharge timings and amounts according to a comparative example.

DESCRIPTION OF THE EMBODIMENTS

Various exemplary embodiments, features, and aspects of the invention will be described in detail below with reference to the drawings.

Figure 1:
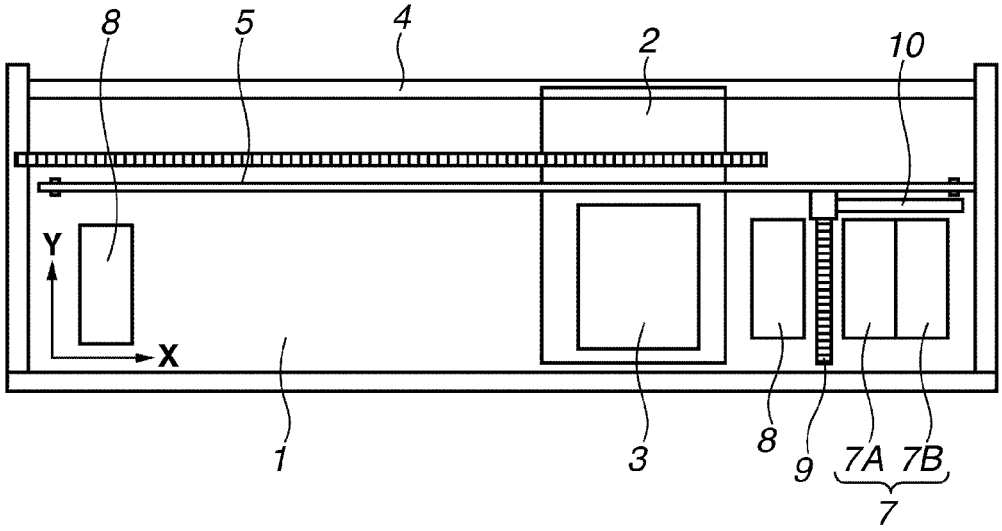
FIG. 1 illustrates a plan view of an ink jet recording apparatus according to an exemplary embodiment of the present invention.

FIG. 1 illustrates a plan view of an ink jet recording apparatus according to a first exemplary embodiment of the present invention.

In FIG. 1, a recording apparatus main unit 1 includes various mechanism units such as a recording medium conveyance unit (not illustrated). The ink jet recording apparatus according to the first exemplary embodiment is a serial-type ink jet recording apparatus. The serial-type recording apparatus executes recording by causing the conveyance unit to convey a recording medium intermittently in a Y direction (sub-scanning direction) and a recording head 3 to make a reciprocating motion for scanning in an X direction (main-scanning direction) perpendicular to the Y direction. Further, the recording apparatus main unit 1 shown in FIG. 1 is large in the X direction so that recording can be executed on a relatively large-sized recording medium (size A1, for example).

In FIG. 1, the recording head 3 is detachably mounted on a carriage 2. The carriage 2 and the recording head 3 make a reciprocating motion for scanning in the X direction perpendicular to the direction in which a recording medium is conveyed. More specifically, the carriage 2 is movably supported along a guide shaft 4 disposed in parallel to the X direction and is also fixed to an endless belt 5 that moves in a direction substantially parallel to the guide shaft 4. Driving force generated by a carriage motor (not illustrated) causes the endless belt 5 to make a reciprocating motion, and as a result, the carriage 2 makes a reciprocating motion for scanning in the X direction (main-scanning direction).

Figure 2:
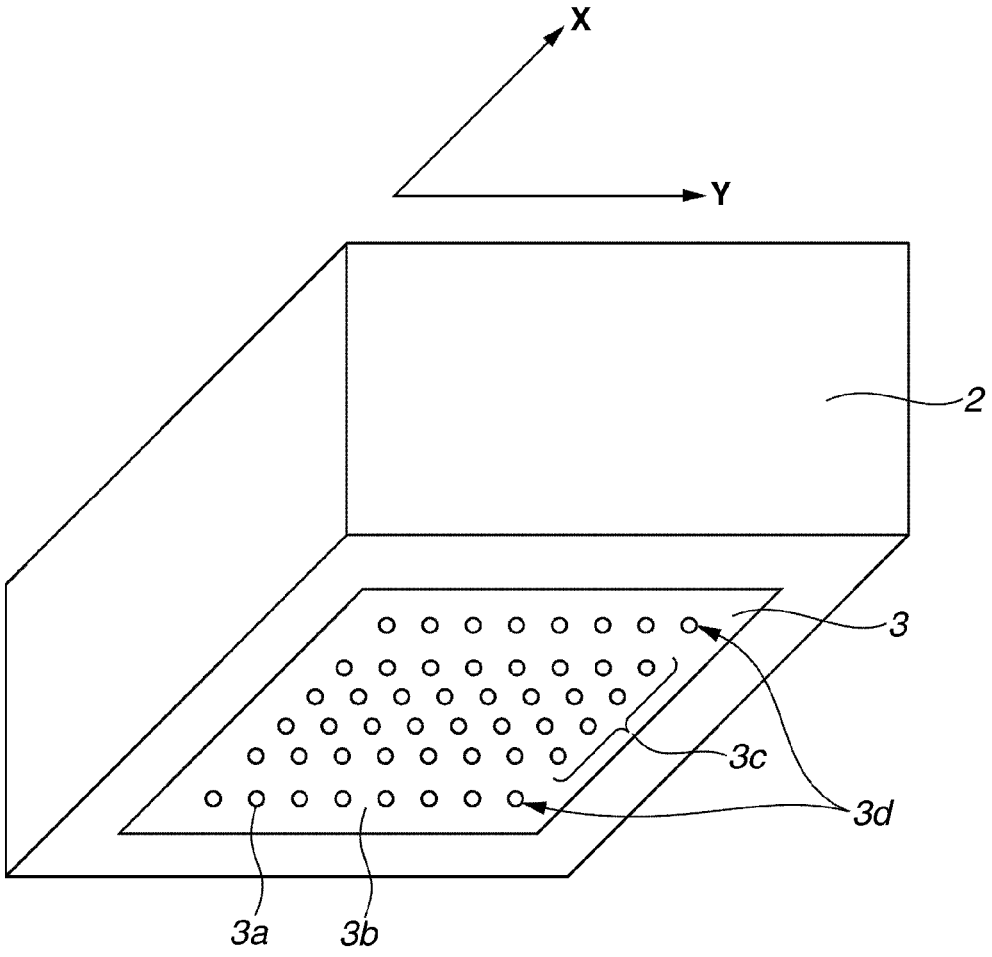
FIG. 2 illustrates a recording head according to an exemplary embodiment of the present invention.
Figure 3:
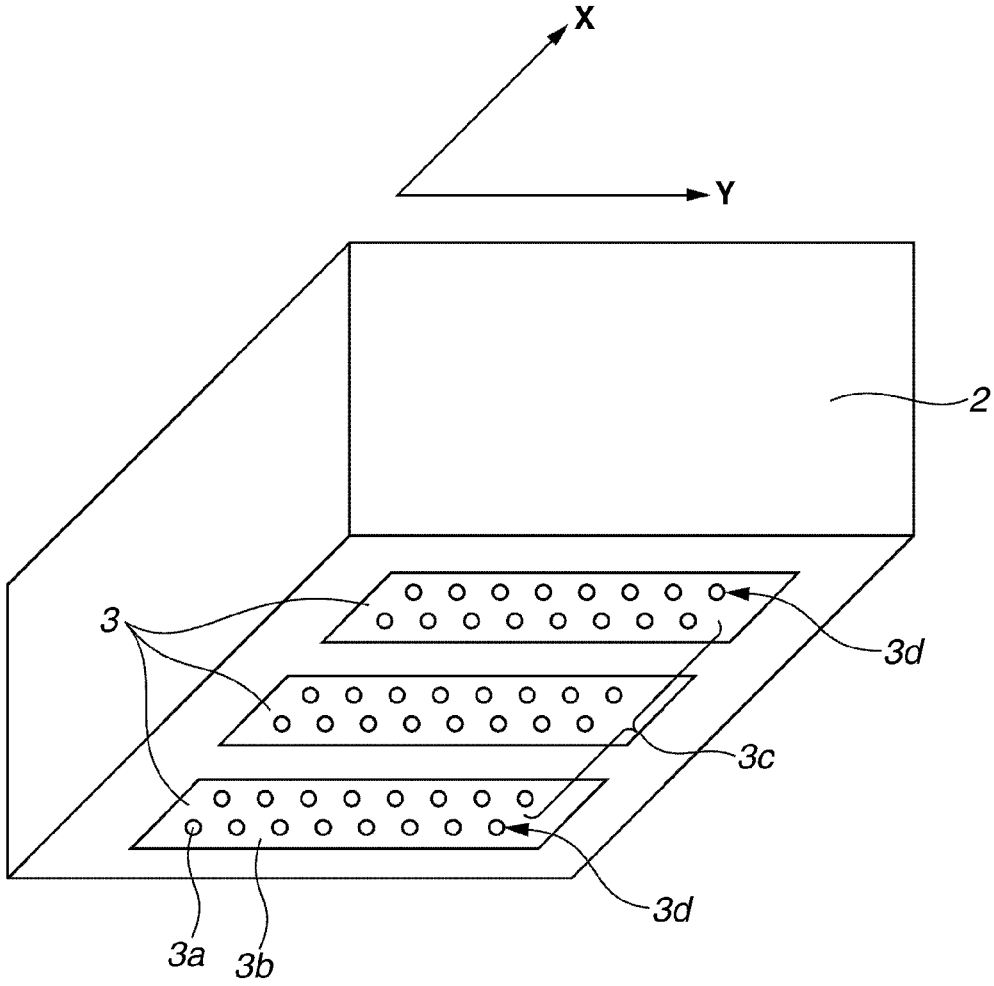
FIG. 3 illustrates a recording head according to an exemplary embodiment of the present invention.
Figure 4:
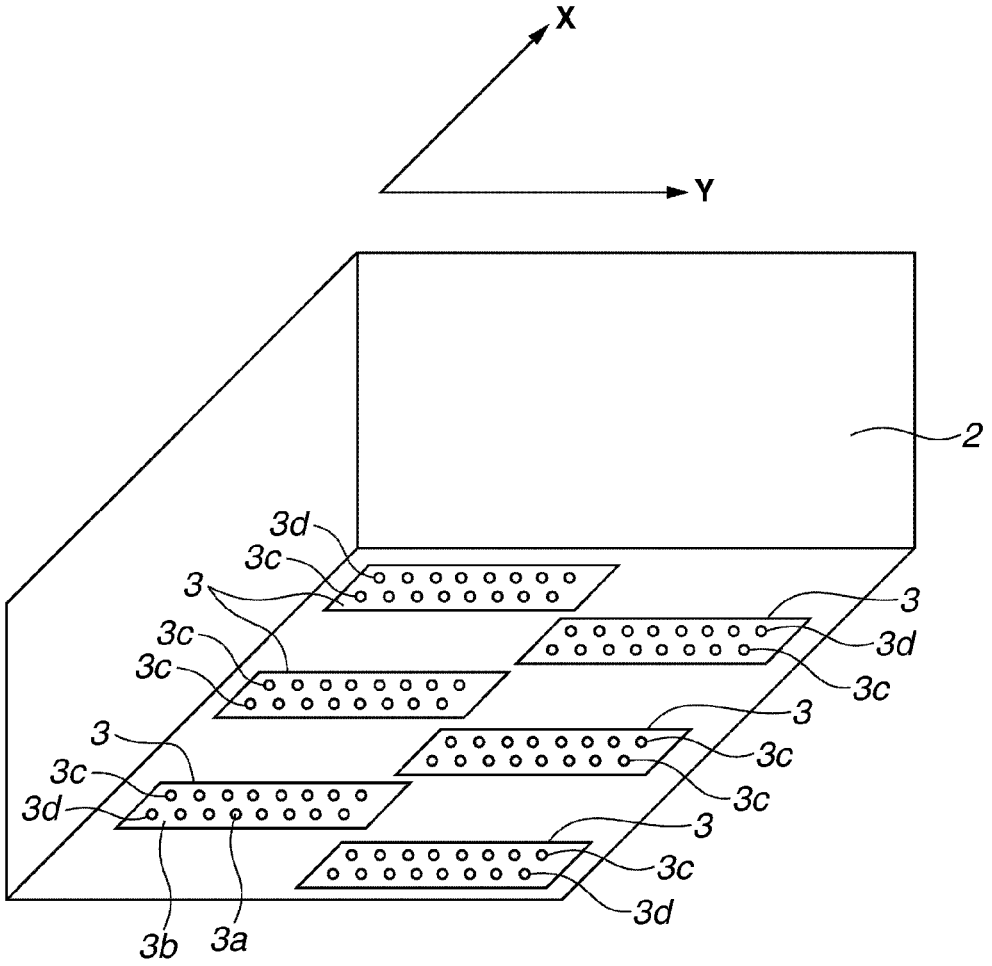
FIG. 4 illustrates a recording head according to an exemplary embodiment of the present invention.
Figure 5:
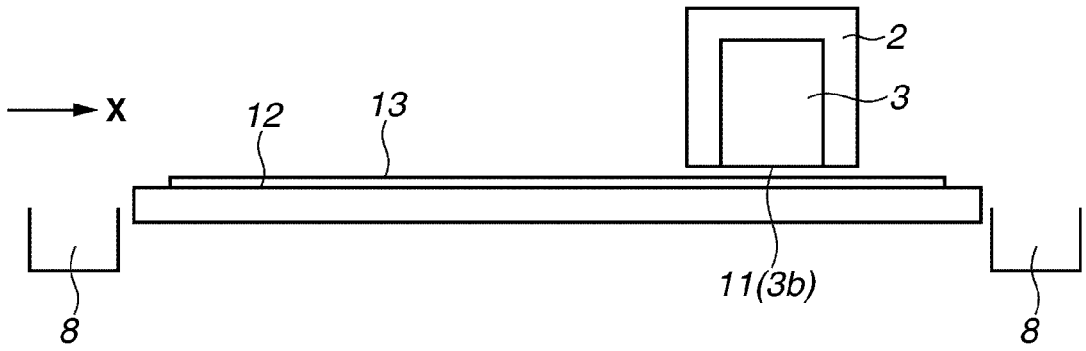
FIG. 5 illustrates a sectional view of an ink jet recording apparatus according to an exemplary embodiment of the present invention.
Figure 6:
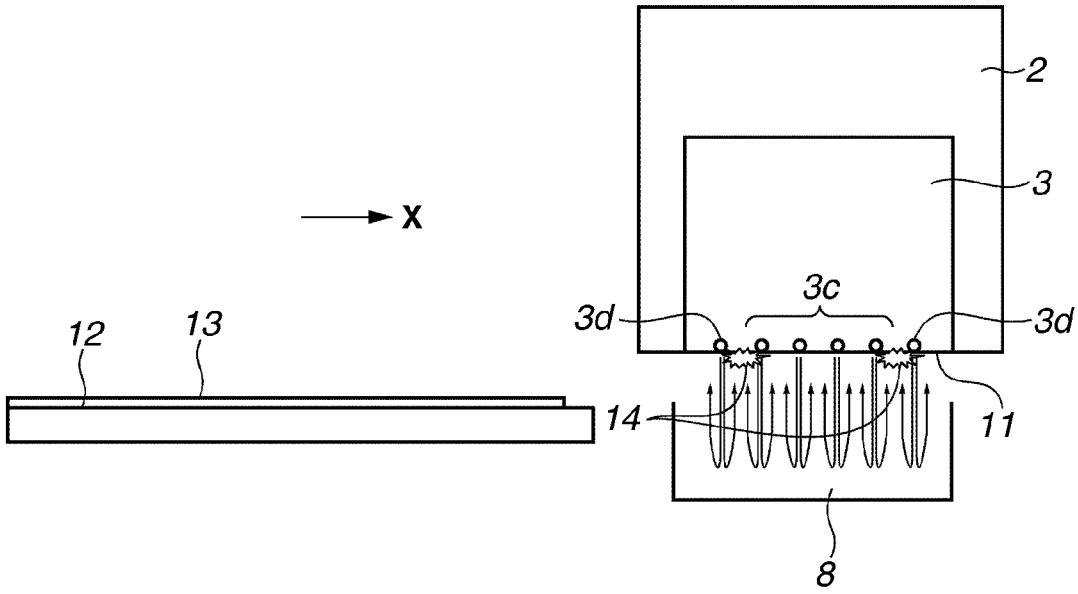
FIG. 6 illustrates air currents during a preliminary discharge according to an exemplary embodiment of the present invention.

Each of FIGS. 2 to 4 illustrates the recording head (s) 3 mounted on the carriage 2 according to the first exemplary embodiment. As shown in FIGS. 2 to 4, to perform bidirectional recording, the recording head 3 includes a discharge port face 3*b* in which a plurality of discharge ports 3*a* are formed. Further, the recording head 3 includes a plurality of liquid channels (not illustrated), each corresponding to a single discharge port 3*a*, and a common liquid chamber (not illustrated) supplying ink to the plurality of liquid channels. The discharge port 3*a* and the liquid channel will be hereinafter referred to as a nozzle.

FIG. 2 illustrates the carriage 2 including a single recording head 3 configured to discharge coloring material-containing ink and reaction liquid. FIG. 3 illustrates the carriage 2 including three recording heads 3 in the X direction, and FIG. 4 illustrates the carriage 2 including a total of six recording heads 3 (in two columns and three rows). In the first exemplary embodiment, each of the recording heads 3 is provided with 1280 discharge ports 3*a* discharging ink of the same color at a density of 1200 dots per inch (dpi) in the Y direction as a predetermined direction, and the carriage 2 makes a reciprocating motion for scanning in the X direction (main-scanning direction). In the first exemplary embodiment, while the carriage 2 makes a reciprocating motion for scanning, since bidirectional recording is executed by discharging reaction liquid first and coloring material-containing ink next, a reaction liquid discharge port array is arranged on either side of an ink discharge port array of the recording head 3.

In FIGS. 2 to 4, an ink discharge port array 3*c* discharges coloring material-containing ink, and the reaction liquid discharge port arrays 3*d* arranged on either side of the ink discharge port array 3*c* discharge reaction liquid that reacts with the coloring material-containing ink. Each of the liquid channels in the recording head 3 is provided with an energy generation element that generates energy to discharge ink from the discharge ports 3*a*. In the first exemplary embodiment, as such energy generation element, an electrothermal converter is used. Based on the electrothermal converter, ink is locally heated to cause film boiling, and the generated pressure is used to discharge the ink. The first exemplary embodiment is not limited to the above electrothermal converter; alternatively, an electromechanical conversion element may be used.

The recording head 3 is supplied with ink from ink tanks each containing ink of a different coloring material. In the first exemplary embodiment, five ink tanks (not illustrated) containing five types of inks, that is, cyan, magenta, yellow, and black ink and reaction liquid that reacts with the inks, can be mounted on the recording apparatus main unit. The inks are supplied from the individual ink tanks attached to the recording apparatus main unit to the corresponding ink supply ports of each of the recording heads 3 via tubes (not illustrated). In this way, the inks are supplied to the corresponding recording heads 3.

In FIG. 1, a recovery processing device 7 maintains the ink discharge performance of each of the discharge ports 3*a* of the recording head 3 in good condition. The recovery processing device 7 is fixed at a predetermined position of the recording apparatus main unit 1 and includes suction recovery mechanisms 7A and 7B. Further, the ink jet recording apparatus according to the first exemplary embodiment includes an elevating mechanism (not illustrated) for lifting and lowering the recovery processing device 7, a wiping recovery device 9, and preliminary discharge receptacles 8.

The suction recovery mechanisms 7A and 7B execute suction recovery processing as one form of recovery processing. In the suction recovery processing, ink is forcibly suctioned from a plurality of nozzles formed in the recording head 3 to replace the ink in the nozzles with ink suitable for discharging. More specifically, the suction recovery mechanisms 7A and 7B cover the discharge port face 3*b* with a cap and generate negative pressure in the cap through a pump (not illustrated), which is in communication with the cap. The negative pressure forcibly suctions ink from the discharge ports 3*a*.

The preliminary discharge receptacles 8 are arranged inside the scanning area of the recording head 3 and outside the recording area thereof. Namely, the preliminary discharge receptacles 8 are arranged outside the area where the recording medium is conveyed. Further, the wiping recovery mechanism 9 is arranged at an end of the scanning path of the recording head 3 (at the home position of the recording head 3, for example), vertically facing the recording head 3. The wiping recovery mechanism 9 includes a blade 10, which is a wiping member for wiping the discharge port face 3*b* of the recording head 3, and an operation unit of the blade 10.

Next, FIG. 11 illustrates a conventional preliminary discharge according to a comparative example, which will be compared with a preliminary discharge according to the first exemplary embodiment. FIG. 11A is a chart showing preliminary discharge timings and amounts according to the comparative example, and in this example, 20 dots/100 pl of ink and reaction liquid is preliminarily discharged. FIG. 11B illustrates the preliminary discharge timings and air currents during discharge, and in the figure, the recording head 3 executes a flow preliminary discharge of ink and reaction liquid into the preliminary discharge receptacles 8 while the carriage 2 executes a scanning operation. As illustrated in FIG. 11B, while the preliminary discharge receptacles 8 are arranged outside the right and left sides of the recording area in the recording head main-scanning direction (in the X direction in the figure), the right and left sides will be hereinafter referred to as "home position (HP) side" and "back position (BP) side," respectively. The recording head 3 executes bidirectional recording by making a reciprocating motion for scanning in the main-scanning direction.

As described above, in FIG. 11B, the reaction liquid discharge port array 3*d* is arranged on either side of the ink discharge port array 3*c* of the recording head 3. As timing (1) illustrates, the carriage 2 is positioned on the HP side before recording, and as timing (2) illustrates, the carriage 2 is next positioned on the BP side after recording. After the timing (2), as timing (3) illustrates, the carriage 2 inverts and is then positioned on the BP side before the next recording. Next, after recording, as timing (4) illustrates, the carriage 2 is then positioned on the HP side again. Thus, the carriage 2 makes a reciprocating motion for scanning in the order of the timings (1) to (4), returning back to the timing (1) again. In the comparative example, scanning operations executed from the timings (1) to (2) and from the timings (3) to (4) will be hereinafter referred to as forward and backward scanning operations, respectively. The recording head 3 preliminarily discharges the ink and the reaction liquid at the pre-recording timings (1) and (3).

Since the reaction liquid is discharged before the ink is discharged, before the carriage 2 executes a forward scanning and recording operation from the timings (1) to (2), the reaction liquid is discharged from the nozzles on the front side of the ink discharge port array 3*c* in a direction in which the recording head 3 travels. Namely, between the reaction liquid discharge port arrays 3*d* arranged on the front and rear sides of the recording head 3, the reaction liquid is discharged from the nozzles of the BP-side (left side in FIG. 11) reaction liquid discharge port array 3*d*. Thus, at the timing (1), the recording head 3 needs to execute a preliminary discharge from the BP-side reaction liquid discharge port array 3*d*, which is used for recording in the next forward scanning operation.

Similarly, at the timing (3), before the carriage 2 executes a backward scanning and recording operation from the timings (3) to (4), the recording head 3 needs to preliminarily discharge the reaction liquid from the reaction liquid discharge port array 3*d* on the front side in a direction in which the recording head 3 travels, namely, from the reaction liquid discharge nozzles on the HP side (right side in FIG. 11).

However, if a preliminary discharge of the reaction liquid is executed from both of the reaction liquid discharge port arrays 3*d* arranged on the front and rear sides of the recording head 3, the ink mist generated from the reaction liquid discharge port array 3*d* on the front side easily attaches to the face of the ink discharge port array. Further, when preliminary discharges of reaction liquid and ink are executed at the same time, the ink mist discharged from adjacent nozzles is rolled up by ascending air currents and then attaches to the discharge port arrays.

Next, a preliminary discharge according to the first exemplary embodiment will be described. As in the above comparative example, the recording head 3 executes bidirectional recording, and the reaction liquid discharge port array 3*d* is arranged on either side of the ink discharge port array 3*c*. FIG. 7A is a chart showing preliminary discharge timings and amounts according to the first exemplary embodiment. FIG. 7B schematically illustrates the preliminary discharge timings. As illustrated in FIG. 7A, as in the comparative example, an ink discharge amount of 20 dots/100 pl is used in a preliminary discharge according to the first exemplary embodiment.

In the first exemplary embodiment, as illustrated in FIG. 7B, between the reaction liquid discharge port arrays 3*d* arranged on the front and rear sides of the ink discharge port array 3*c*, a preliminary discharge of the reaction liquid is executed from only the nozzles of the reaction liquid discharge port array 3*d* on the rear side of the ink discharge port array 3*c* in a direction in which the recording head 3 travels, when the carriage 2 is positioned after recording on the BP side at the timing (2) or on the HP sides at the timing (4). A preliminary discharge of the coloring material-containing ink is executed when the carriage 2 is positioned on the HP side at the pre-recording timing (1) or on the BP side at the pre-recording timings (3).

Consequently, the air currents generated by the carriage scanning cause the ink mist of the coloring material-containing ink to flow in a direction indicated by an arrow Z1 at the pre-recording timing (1) on the HP side, and the air currents cause the ink mist to flow in a direction indicated by an arrow Z3 at the pre-recording timing (3) on the BP side. In contrast, the air currents generated by the carriage scanning cause the ink mist of the reaction liquid to flow in a direction indicated by an arrow Z2 at the post-recording timing (2) on the BP side, and the air currents cause the ink mist to flow in a direction indicated by an arrow Z4 at the post-recording timing (4) on the HP side. Thus, since preliminary discharges of the ink and reaction liquid are executed at different timings, and the air currents generated by the carriage scanning cause the ink mist to flow backward in a direction in which the recording head 3 travels, adhesion of the ink mist to the discharge port face 3*b* can be suppressed.

As described above, according to the first exemplary embodiment, after recording is executed on a recording medium by a predetermined scanning operation, a preliminary discharge of the reaction liquid is executed from a reaction liquid discharge port array 3*d*. In addition, a flow preliminary discharge is executed only from the reaction liquid discharge port array 3*d* arranged on the rear side of the ink discharge port array 3*c* in a direction in which the recording head 3 travels.

Further, a preliminary discharge of the ink is executed from the ink discharge port array 3*c* when a preliminary discharge of the reaction liquid is not executed from the reaction liquid discharge port array 3*d*. In the first exemplary embodiment, a preliminary discharge of the ink is executed after the predetermined scan and carriage inversion and before recording is executed on the recording medium by the next scanning operation. Thus, since a preliminary discharge of the ink is executed from the ink discharge port array 3*c* before recording is executed on a recording medium by the predetermined scanning operation, ink used for the next recording can be maintained at an optimum state. As a result, stable recording image quality can be maintained.

Additionally, in the first exemplary embodiment, since the preliminary discharge timings can be optimally controlled, the amount of waste ink unnecessarily discharged from the reaction liquid discharge port arrays 3*d* can be reduced. Generally, in bidirectional recording, since the reaction liquid is first applied to a recording medium prior to the ink, between the reaction liquid discharge port arrays 3*d* arranged on the front and rear sides of the ink discharge port array 3*c*, the reaction liquid discharge port array 3*d* arranged on the front side of the ink discharge port array 3*c* in a direction in which the recording head 3 travels is first used for recording. Thus, nozzles that need to be maintained at an optimum ink discharge state by preliminary discharge immediately before recording are the nozzles which will be used for the next recording, more specifically, only the reaction-liquid nozzles arranged on the front side of the ink discharge port array 3*c* in a direction in which the recording head 3 travels. Namely, if a preliminary discharge of the reaction liquid is executed from both of the reaction liquid discharge port arrays 3*d* arranged on the front and rear sides of the ink discharge port array 3*c* at the same time, the ink discharged by a preliminary discharge from the reaction liquid discharge port array 3*d* on the rear side of the ink discharge port array 3*c* in a direction in which the recording head 3 travels will be wasted unnecessarily. In the first exemplary embodiment, since a preliminary discharge of the reaction liquid is executed only from the reaction liquid discharge port array 3*d* on the rear side of the ink discharge port array 3*c* in a direction in which the recording head 3 travels at post-recording timing, the amount of waste ink can be reduced.

A second exemplary embodiment of the present invention will be hereinafter described. The overall structure of the ink jet recording apparatus according to the second exemplary embodiment is similar to that of the first exemplary embodiment.

FIG. 8A is a chart showing preliminary discharge timings and amounts according to the second exemplary embodiment, and FIG. 8B illustrates the preliminary discharge timings.

In FIG. 8, the recording head 3 mounted on the carriage 2 executes a preliminary discharge of the coloring material-containing ink at the pre-recording timings (1) and (3) on the HP and BP sides, respectively. Next, as in the first exemplary embodiment, at the post-recording timings (2) and (4) on the BP and HP sides, respectively, the recording head 3 executes a preliminary discharge of the reaction liquid. At these timings (2) and (4), while the reaction liquid discharge port array 3*d* arranged on the rear side of the ink discharge port array 3*c* on the recording head 3 in a direction in which the carriage 2 travels mainly discharges the reaction liquid, the reaction liquid discharge port array 3*d* on the front side of the ink discharge port array 3*c* also discharges the reaction liquid. However, an amount of the reaction liquid discharged from the reaction liquid discharge port array 3*d* on the front side is less than that of the reaction liquid discharged from the reaction liquid discharge port array 3*d* on the rear side.

In the second exemplary embodiment, as in the first exemplary embodiment, since a preliminary discharge of the ink is executed when a preliminary discharge of the reaction liquid is not executed, rolling-up of the ink mist and ink adhesion to the discharge port face 3*b* caused by the ascending air currents generated by a preliminary discharge can be suppressed. Additionally, a preliminary discharge of the reaction liquid is executed not only from the nozzles on the rear side but also from the nozzles on the front side of the ink discharge port array 3*c* in a direction in which the carriage 2 travels.

In the second exemplary embodiment, an amount of unnecessary waste ink is increased compared with that in the first exemplary embodiment. However, when bidirectional recording is executed, since the reaction liquid is only discharged from either the front-side or rear-side reaction liquid discharge port array 3*d* in the first exemplary embodiment, the reaction liquid can be thickened more easily. Thus, by executing a preliminary discharge of the reaction liquid from both of the reaction liquid discharge port arrays 3*d* arranged on the front and rear sides of the ink discharge port array 3*c*, the chance of a defective discharge can be reduced. Furthermore, since the front-side and rear-side reaction liquid discharge port arrays 3*d* sandwich the ink discharge port array 3*c* and the nozzles of each of the reaction liquid discharge port arrays 3*d* are separated, the impact of the generated ascending air currents is small, and the ink mist does not easily roll up.

Additionally, since the amount of the reaction liquid discharged from the discharge port array 3*d* arranged on the front side of the ink discharge port array 3*c* in a direction in which the recording head 3 travels is less than that of the reaction liquid discharged from the reaction liquid discharge port array 3*d* on the rear side of the ink discharge port array 3*c* in a direction in which the recording head 3 travels, the second exemplary embodiment is effective in reducing ink mist adhesion.

A third exemplary embodiment of the present invention will be hereinafter described. The overall structure of the ink jet recording apparatus according to the third exemplary embodiment is similar to that of the first exemplary embodiment.

FIG. 9A is a chart showing preliminary discharge timings and amounts according to the third exemplary embodiment, and FIG. 9B schematically illustrates the preliminary discharge timings.

The third exemplary embodiment may be used when the frequency of preliminary discharges can be reduced, and in the third exemplary embodiment, a preliminary discharge of the coloring material-containing ink is executed only either on the HP or BP side. In FIG. 9, the recording head 3 mounted on the carriage 2 executes a preliminary discharge of the coloring material-containing ink from the ink discharge port array 3*c* at the pre-recording timing (1) on the HP side. Next, as in the first exemplary embodiment, the recording head 3 executes a preliminary discharge of the reaction liquid from the nozzles of the reaction liquid discharge port array 3*d* on the rear side of the ink discharge port array 3*c* in a direction which the recording head 3 travels at the post-recording timings (2) and (4) on the BP and HP sides, respectively.

Thus, the third exemplary embodiment is also effective in suppressing the above ink adhesion caused by rolling-up of ink mist. Additionally, since a preliminary discharge of the coloring material-containing ink is executed from the ink discharge port array 3*c* into a single preliminary discharge receptacle 8 on one side, the recording speed can also be increased.

Additionally, FIGS. 10A and 10B illustrate an example in which preliminary discharges of the reaction liquid and ink are executed only on either the HP or BP side. In FIG. 10, since a preliminary discharge of the reaction liquid is executed only at the post-recording timing (4) on the HP side, during a preliminary discharge, the recording head 3 discharges the same amount of the reaction liquid from the nozzles of the reaction liquid discharge port arrays 3*d* arranged on the front and rear sides of ink discharge port array 3*c* in a direction in which the recording head 3 travels. While more ink mist may roll up and adhere to the discharge port face 3*b* compared with the other exemplary embodiments, since a preliminary discharge of the reaction liquid is executed only on the HP side, the third exemplary embodiment has the advantage that recording can be executed at a higher speed.

The preliminary discharge according to the third exemplary embodiment is used when the frequency of preliminary discharges can be reduced; in other words, when the recording speed can be increased. It can be expected that the third exemplary embodiment is mainly used when recording is executed on a small-sized recording medium. Thus, the ink jet recording apparatus according to the present invention may be controlled, so that when the image quality is a priority (when recording is executed on a large-sized recording medium, for example), the first or second exemplary embodiment may be used as a first mode, and when the recording speed is a priority (when recording is executed on a small-sized recording medium, for example), the third exemplary embodiment may be used as a second mode.

While preliminary discharges of the ink and reaction liquid are executed while the recording head 3 executes continuous scanning in the above exemplary embodiments, the present invention is not limited to such operation. The preliminary discharge timings can be controlled. Namely, depending on the size of the recording medium or the type of the ink, preliminary discharges of the ink and reaction liquid may be executed once in a plurality of reciprocating scanning operations, and even in such a case, the present invention is effective. Further, the frequency of preliminary discharges of the ink and that of preliminary discharges of the reaction liquid may be made different and controlled separately.

In the above exemplary embodiments, a preliminary discharge of the ink is executed before a predetermined scanning operation and recording on a recording medium, and a preliminary discharge of the reaction liquid is executed after the predetermined scanning operation and recording on the recording medium. However, the present invention is not limited to such operation. When a preliminary discharge of the ink is not executed before the predetermined scanning operation, a preliminary discharge of the reaction liquid may be executed before recording on the recording medium. Likewise, when a preliminary discharge of the reaction liquid is not executed, a preliminary discharge of the ink may be executed after recording. In such a mode, the present invention is also effective in suppressing ink mist adhesion and reducing unnecessary waste ink.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-041000 filed Feb. 24, 2009, which is hereby incorporated by reference herein in its entirety.

What is claimed is:

1. An ink jet recording apparatus comprising:

a recording head comprising a discharge port face having an ink discharge port array that is sandwiched in a predetermined direction by a first reaction liquid discharge port array and a second reaction liquid discharge port array, wherein each discharge port array includes a plurality of discharge ports, wherein the ink discharge port array is configured to discharge coloring material-containing ink as ink and each reaction liquid discharge port array is configured to discharge reaction liquid configured to react with the ink;

a scanning unit configured to cause the recording head to execute reciprocating scanning motion to perform a recording operation in a forward direction and a recording operation in a backward direction of the predetermined direction across a recording area located within a scanning area; and a preliminary discharge control unit configured to control the recording head to execute a preliminary discharge of the ink or the reaction liquid after ending a recording operation in the recording area and before starting a recording operation in the recording area, wherein, the preliminary discharge control unit causes the ink jet recording apparatus to perform a first preliminary discharge operation of performing, after the recording head executes the recording operation in the forward direction and while the recording head moves in the forward direction, a preliminary discharge from the reaction liquid discharge port array located downstream, in the forward direction, of the other reaction liquid discharge port array while not performing a preliminary discharge from the other discharge port arrays, and to perform a second preliminary discharge operation of performing, before the recording head executes the next recording operation in the backward direction and after the recording head moves in the forward direction, a preliminary discharge from the ink discharge port array while not performing a preliminary discharge from the first reaction liquid discharge port array and the second reaction liquid discharge port array.

2. The ink jet recording apparatus according to claim 1, wherein the recording head performs a recording operation in the recording area by discharging the ink onto a recording medium onto which the reaction liquid has been discharged.

3. The ink jet recording apparatus according to claim 1, wherein the first preliminary discharge operation and the second preliminary discharge operation are executed outside an area where the recording head executes a recording operation on a recording medium.

4. The ink jet recording apparatus according to claim 1, further comprising an ink receiving member configured to receive preliminarily discharged ink and preliminarily discharged reaction liquid, wherein the ink receiving member is located at a distance from the discharge port face that is far enough to cause a likelihood of mist roll up due to preliminary discharge of reaction liquid and ink at a same timing.

5. The ink jet recording apparatus according to claim 1, wherein, in response to the recording head reaching a position outside of the recording area after ending a second recording operation in the recording area in which the second reaction liquid discharge port array trailed the first reaction liquid discharge port array, the preliminary discharge control unit causes the second reaction liquid discharge port array to discharge reaction liquid as a second preliminary discharge operation and, at a same timing and before beginning a third recording operation, causes the ink discharge port array to refrain from discharging ink and causes the first reaction liquid discharge port array to refrain from discharging reaction liquid.

6. The ink jet recording apparatus according to claim 1, wherein the reaction liquid configured to react with the discharge coloring material-containing ink on a recording medium to suppress ink bleeding and increase ink density.

7. A method for an ink jet recording apparatus, the method comprising:

causing a recording head to execute reciprocating scanning motion to perform a recording operation in a forward direction and a recording operation in a backward direction of a predetermined direction across a recording area located within a scanning area, wherein the recording head includes a discharge port face having an ink discharge port array that is sandwiched in the predetermined direction by a first reaction liquid discharge port array and a second reaction liquid discharge port array, wherein each discharge port array includes a plurality of discharge ports, wherein the ink discharge port array is configured to discharge coloring material-containing ink as ink and each reaction liquid discharge port array is configured to discharge reaction liquid configured to react with the ink; and controlling the recording head to execute a preliminary discharge of the ink or the reaction liquid after ending a recording operation in the recording area and before starting a recording operation in the recording area, wherein, controlling includes causing the ink jet recording apparatus to perform a first preliminary discharge operation of performing, after the recording head executes the recording operation in the forward direction and while the recording head moves in the forward direction, a preliminary discharge from the reaction liquid discharge port array located downstream, in the forward direction, of the other reaction liquid discharge port array while not performing a preliminary discharge from the other discharge port arrays, and to perform a second preliminary discharge operation of performing, before the recording head executes the next recording operation in the backward direction and after the recording head moves in the forward direction, a preliminary discharge from the ink discharge port array while not performing a preliminary discharge from the first reaction liquid discharge port array and the second reaction liquid discharge port array.

* * * * *